United States Patent [19]

Eckernäs et al.

[11] Patent Number: 5,072,430

[45] Date of Patent: Dec. 10, 1991

[54] COMPLIANCE METER FOR CLINICAL EVALUATION OF DRUGS

[75] Inventors: Sven-Åke Eckernäs; Bengt Dahlström, both of Upsala, Sweden

[73] Assignee: Compumed AB, Upsala, Sweden

[21] Appl. No.: 572,944

[22] PCT Filed: Mar. 29, 1989

[86] PCT No.: PCT/SE89/00162

§ 371 Date: Sep. 21, 1990

§ 102(e) Date: Sep. 21, 1990

[87] PCT Pub. No.: WO89/09042

PCT Pub. Date: Oct. 5, 1989

[30] Foreign Application Priority Data

Mar. 29, 1988 [SE] Sweden ..... 8801163

[51] Int. Cl.[5] ..... G04B 47/00; B65D 83/04

[52] U.S. Cl. ..... 368/10; 206/534; 221/3

[58] Field of Search ..... 368/10, 107, 113; 206/534; 221/2, 3, 15

[56] References Cited

U.S. PATENT DOCUMENTS 4,526,474 7/1985 Simon ..... 368/10
4,660,991 4/1987 Simon ..... 368/10
4,731,765 3/1988 Cole et al. ..... 368/10

FOREIGN PATENT DOCUMENTS 0191168 8/1986 European Pat. Off. .
2198425 6/1988 United Kingdom .

*Primary Examiner*—Vit W. Miska
*Attorney, Agent, or Firm*—Young & Thompson

[57] ABSTRACT

A device for signalling the ingestion of medicaments in tablet form packed in blister packs in which the various tablet compartments on one side are delimited by a metal foil sheet which is common to the pack as a whole. A sheet (12) of insulating material has provided therein holes (20) which are so arranged as to correspond to the positions of the tablets in the pack. Electrodes (10, 11) having an electrically conductive surface are disposed circumferentially around each hole on one side of the sheet. A first number (10) of these electrodes is mutually connected to a first signal conductor, and a second number of these electrodes is mutually connected to a second signal conductor. The foil (2) is arranged such that when a tablet is removed through a hole in the blister pack located in the device, an electric contact is made between an electrode of the first number of electrodes (10) and an electrode of the second number of electrodes (11) and therewith an electric connection is established between the first and the second signal conductors. The first conductors from all of the first number of electrodes (10) are mutually connected to a common first signal conductor (100), and the second signal conductors (110, 111, 112) are each connected to a respective input of a sensing circuit (FIG. 6).

5 Claims, 3 Drawing Sheets

COMPLIANCE METER FOR CLINICAL EVALUATION OF DRUGS

When evaluating the usefulness of drugs, it is necessary to carry out lengthy and costly trials to establish their effectiveness and also to establish any side-effects that they might have. In fact, it is not possible to register new drugs and medicaments with government authorities unless usefulness and a reasonable absence of side-effects can be shown.

A particular difficulty encountered in trials of this nature derives from the so-called placebo effect, which enables a patient to be helped, both subjectively and even objectively, with the aid of "sugar pills", provided that the patient believes that he has been administered with an effective drug. It is doubtful that drugs can be effectively tested against the effect of placeboes, unless the doctor concerned is also unaware of which tablets contain the placebo and which contain the active drug, since otherwise the doctor may inadvertently divulge to the patient, in some way or another, the fact that a particular tablet is nothing more than a placebo. The practice of double blind trials is therefore widespread and necessary.

An idea of the difficulties encountered when testing drugs is given by the clinical observation that a patient administered with a placebo may also complain of side-effects resulting therefrom. In the case of one reported study in which patients were administered with placeboes, no less than a quarter of the patients concerned discontinued taking the placebo, because of the side-effects felt to be caused thereby (Capel et al, J. Rheumatol. 6 (1979) 584–593).

The standard procedure in clinical drug trials is to supply the patients concerned with blister cards or charts containing the drug in tablet form, together with a prescription as to how many tablets should be taken and at what times. The patient is also instructed to make notes relevant to the treatment. This is particularly important in the case of short-lived drugs, such as pain relieving drugs. One problem with such practices is that the patient may forget to make notes at the times prescribed and attempt to rectify this omission at a later date, for instance immediately prior to seeing his doctor. Cases are also known where a patient who has forgotten to take his tablets, removes a few from the blister chart and throws them away, thus pretending to have taken the tablets and therewith avoiding the doctor's displeasure.

Consequently, it is an object of this invention to provide a compliance meter with which many of the pitfalls experienced in drug trials can be avoided. By compliance is meant here the strict obedience of the patient in following the doctor's instruction as to the times when the drugs (tablets) are to be taken and in what quantities, or, in a relative sense, how the tablets were taken and when, in those cases, for instance, when the patient was told to take a tablet when and if the need was felt.

Known to the art are devices which signal to a patient when a tablet should be taken and which stop signalling when the tablet is removed from the pack, these devices functioning in the manner of an alarm clock.

Some devices of this kind are constructed to receive a blister pack and means are provided for detecting when a blister pad is broken and a tablet is freed therefrom, whereupon the "alarm clock" is switched off and is not restarted until the next time a tablet is to be taken.

Examples of such devices are to be found in DE-A-33 35 301 and EP-A-0 191 168.

Although such devices have been found practical from the aspect of patient treatment, thereby overcoming the forgetfullness of old or very sick patients, they are not particularly useful for the purpose of the present invention.

One particularly important advantage afforded by the present invention is that it is thereby made possible to register the time at which a tablet is taken from the blister pack and also the tablet which was taken at that time. This is of particular value when the tablets concerned are a mixture of different tablets and, for instance, comprise placebo tablets. For example, when testing the effect of pain relieving tablets which the patient or subject is allowed to take at will, it is extremely valuable to know the length of time which passes before a further tablet is taken and also how this length of time varies with the type of tablet taken. In accordance with the inventive concept, these times are stored in a memory so as to enable them to be analyzed, therewith providing results which could hardly be otherwise obtained at reasonable cost.

In accordance with the invention, the device comprises a blister card holder, means for pressing a tablet from the card, and an electric sensor located at each tablet position. Devices of this kind are known to the art, e.g. from the aforesaid patent publications.

According to one preferred embodiment of the invention, the aluminum foil which is normally present in such blister packs is used to make a connection between electric contacts located in the pack holder.

According to one important feature of the invention, all of the tablet locations can be sensed and a removed tablet identified. Preferably, a conductor or lead is drawn from each tablet location to a selector network, such as to allow the tablets or tablet locations to be sensed individually. This is of particular advantage when the aluminum foil present is used as a means of making electric contact, since once made the contact can be maintained indefinitely. When using individual holder-mounted electric contact devices or switches which are arranged so as to be activated only when a tablet is pushed from the pack, it may be possible instead to use a multiplexed sensing system and therewith to limit the number of input leads to one set of column leads and one set of row leads, as will be understood by those skilled in this art.

According to one advantageous embodiment, the inventive device is provided with a lid provided with holes which correspond to the tablet positions, which lid may either be collapsible or, together with the contact-carrying card, form a pocket which will enable a blister pack to be inserted from one side.

The device may also be provided with a code reading facility which is effective in reading a code on the package. This code may have the form of a bar code, or a margin notch or recess code capable of being sensed by microswitches, which in other respects may be coordinated with those electrical contact elements or switches which are closed automatically as the blister pack is opened.

According to one beneficial application, the inventive device is coupled to a computer equipped with a text screen and a keyboard or button bank through which a patient is able to answer questions concerning his condition, e.g. the level of pain felt, the computer being able to store both the drug intake of the patient and the result achieved, which greatly enhances the level of reliability, since the test is no longer reliant on the memory of the patient or his ability to make notes, especially when the patient is weakened by sickness. The use of such an auxiliary arrangement supplemented to a greater or lesser degree, in cases of regular treatment, can also be effective in so reducing the extent of personal care as to enable patients who might otherwise need to be hospitalized to be cared for in their homes.

The invention will be understood more readily from the following description of an exemplifying, non-limiting embodiment thereof.

Figure 1:
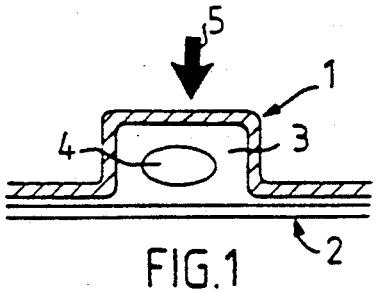
FIG.1 (PRIOR ART)
FIG. 1 illustrates the principle of the known blister pack.
Figure 2:
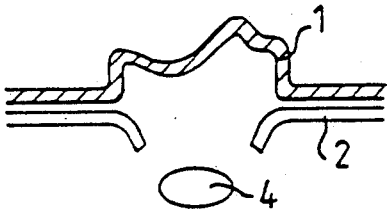
FIG.2 (PRIOR ART)
FIG. 2 illustrates the manner of removal of tablets from a blister pack according to FIG. 1.
Figure 3:
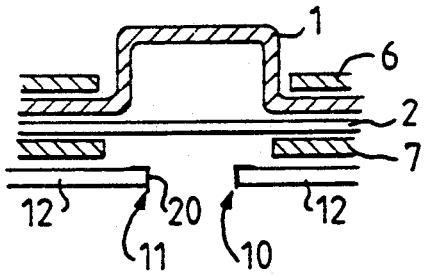
FIG. 3 shows part of a blister pack mounted in a device according to the invention.

A tablet 4 packed in a blister pack is shown in FIG. 1. The blister pack has a first plastic layer 1, which is normally transparent, and which has pressed therein recesses or alveoli 3 in which tablets 4 are placed. The alveoli are covered with aluminum foil 2 which is secured with an adhesive. When the foil is depressed by the finger in the direction of the arrow 5, the layer is deformed and the tablet 4 will be pushed through the aluminum foil 2, which deforms, bulges outwardly and subsequently ruptures. FIG. 3 illustrates a type of blister pack in which the said layers are placed between two pieces of perforated cardboard 6 and 7, which is particularly suitable in respect of the present invention. According to the invention, when in use the blister pack lies on a sheet 12 of insulating material provided with holes which lie opposite the locations of respective tablets. Electrodes 10 and 11 are located at the edges of the holes. When the blister pack is broken open, as illustrated in FIG. 2, the aluminum foil will make electric contact with the electrodes 10 and 11. In those cases when the blister pack lacks a cardboard sheet, it will be necessary to include a cardboard insert, in order to ensure that a space is obtained between the foil 2 and the electrodes 10 and 11.

Figure 4:
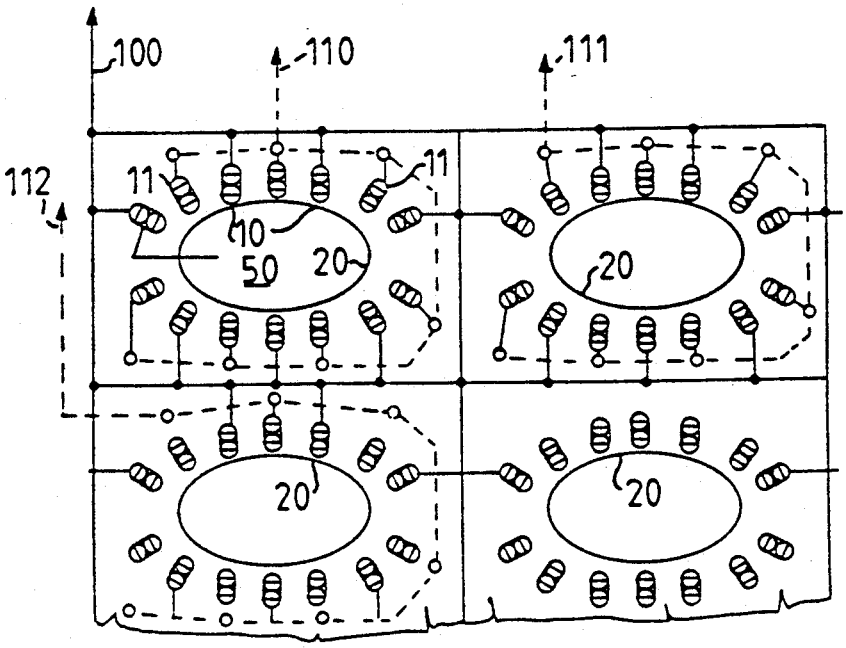
FIG. 4 shows part of a circuit card.
Figure 5:
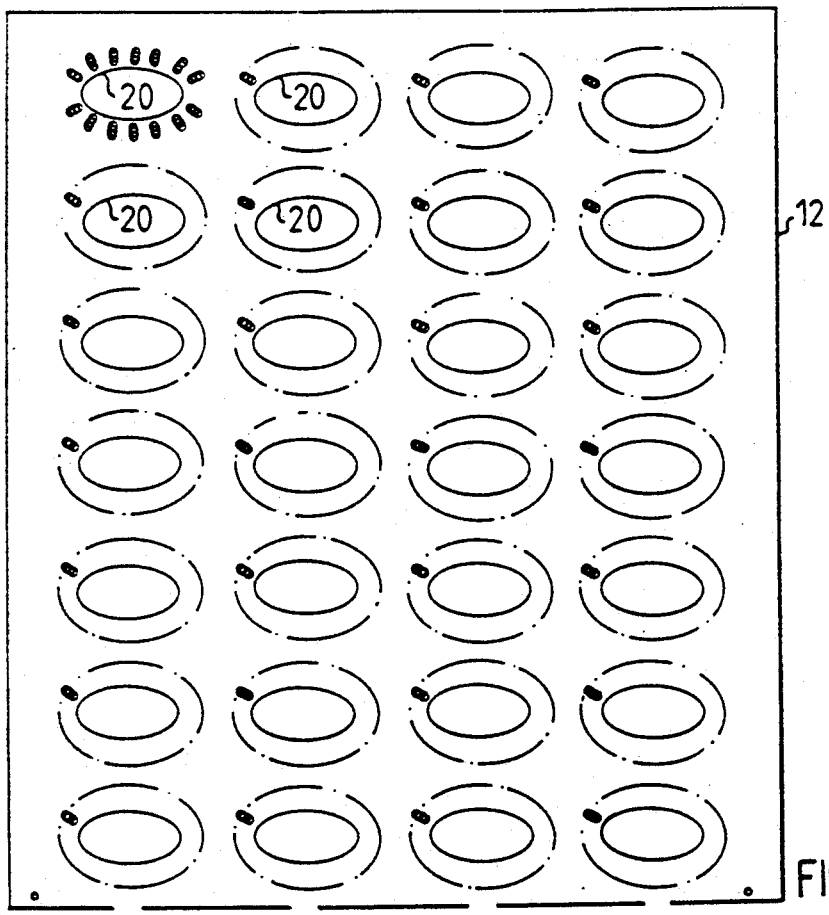
FIG. 5 illustrates a perforated circuit card provided with sensing electrodes.

FIG. 5 illustrates a plate for a blister pack containing 28 tablet sites or locations, there being 20 holes at each tablet location. The positioning of the electrodes and the requisite circuitry will be seen best from FIG. 4. A multiple of electrodes, here 14, are arranged around the holes 20 and are connected such that all alternate electrodes, the electrodes 10, are mutually connected to a common first signal conductor, which will normally be grounded, via a grid net arranged on the same side of the plate, which will normally be a circuit card. The remaining electrodes, referenced 11, are mutually connected at each tablet site or location to a conductor on the rear side, via metallized holes, and form a multiple of second signal conductors, such as 110, 111 and 112 in FIG. 4, the number of second signal conductors being equal to the number of tablet locations.

Thus, when a tablet is removed from the pack, an electrical contact is established between the first signal conductor 100 and one of the second signal conductors, e.g. the conductor referenced 110 in FIG. 4 when the tablet is removed from the tablet location 50 shown in the top left quadrant of FIG. 4.

Figure 6:
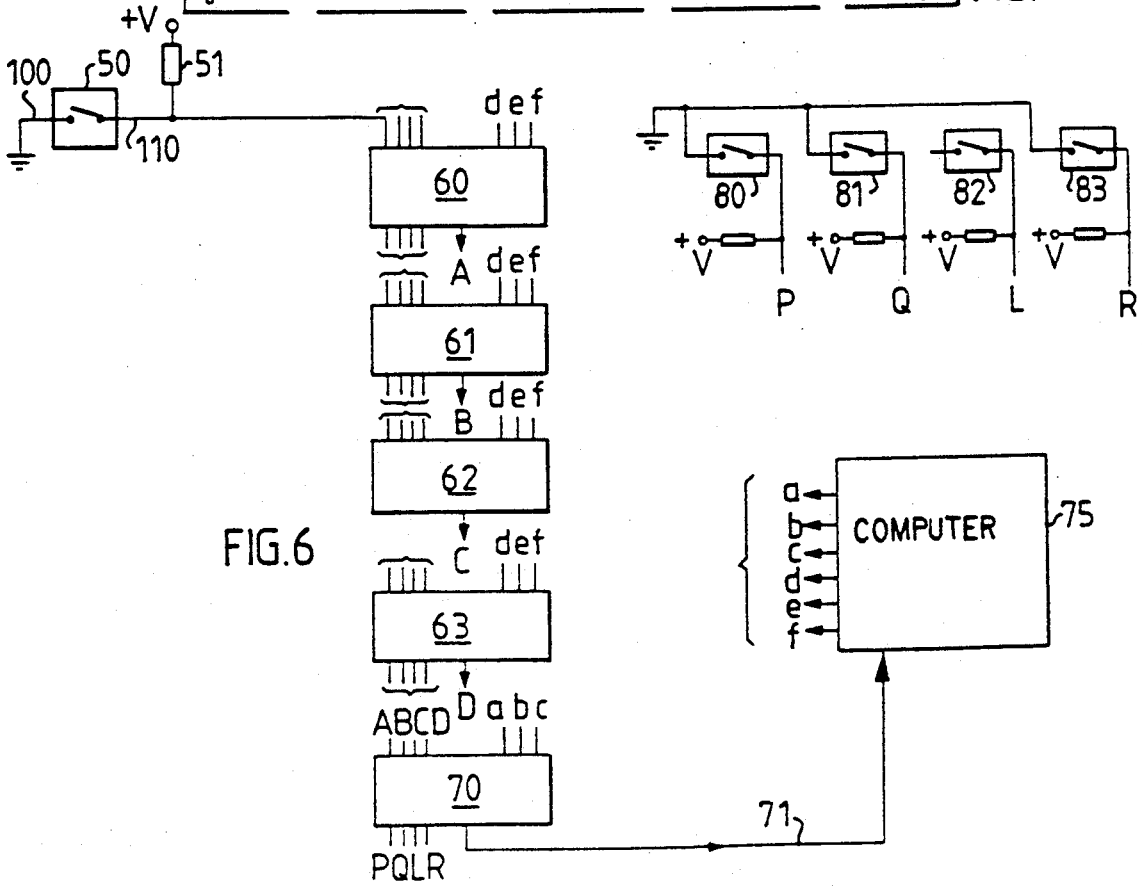
FIG. 6 illustrates an electronic circuit for sensing a device according to the invention.

FIG. 6 illustrates schematically the manner in which these "switches" are used, one for each tablet. For the sake of simplicity in illustration, only one such "switch" 50 has been shown, although it will be understood that the number provided may equal the number of tablet locations.

The circuitry illustrated in FIG. 6 incorporates five integrated circuits 60–63 and 70 of the kind designated HC 151 (Motorola).

These integrated circuits each have eight signal inputs, three address inputs and one output. Logic circuits ensure that for each possible digital address, i.e. eight addresses, the state of one of the signal inputs is sensed (high or low), and the output will then show a correspondingly high or low value. It will be seen from the Figure that the "switch" 50, which corresponds to a tablet location, will normally function as an open switch, prior to taking a tablet from the pack. In this state of the switch, the other signal conductor of the switch is not connected to ground, but has a high level due to being connected to positive voltage +V, via a resistance 51. The other signal conductor is connected to one of the unmarked signal inputs on the circuit 60.

Each of all other signal conductors from the remaining tablet locations (not shown) is connected to a respective signal input on one of the circuits 60, 61, 62 or 63. The device illustrated in FIG. 6 is thus able to accommodate other signal conductors, to a total of 32.

A computer 75 is provided for reading all "switches", such as 50. In operation, digital signals are transmitted on six parallel outputs a–f. The three least significant bits d, e and f, are connected to the three address inputs on the circuits 60, 61, 62 and 63. Each of the outputs A, B, C, D of these circuits 60, 61, 62 and 63 is connected to a respective signal input on the circuit 70, which is of the same type as the others. Thus, a signal input on each of the circuits 60–63 is indicated through the three least significant bits d, e, and f, and if, for instance, the illustrated "switch" 50 is closed (tablet removed), the output signal A from this switch will be high when indicated by the bits d, e and f. When the bits a, b and c, which are connected to the circuit 70, then indicate the input A, a high signal will pass to the computer.

The computer is programmed to address the bit sites or locations in sequence, for instance every tenth of a second. If a tablet signals that the "switch" is closed, the computer leaves the search loop and repeats the indication towards the signalled tablet location, e.g. seven times, in order to make absolutely certain that the tablet has been removed and the switch closed, whereafter the identity of the tablet removed and the time of its removal are stored in the memory of the computer.

The program may suitably be such that once a tablet has been removed, the computer will no longer include this particular location in its periodic search.

In accordance with a preferred embodiment, the inventive device also includes four microswitches 80–83, which are activated by the edge of the pack upon its insertion. For instance, said edge may have provided therein an opening which when located opposite one of the microswitches, causes the switch to be open, whereas the switch is closed in the absence of such an opening. In this way, 14 mutually different configurations can be recognized ("all open" will signal the absence of the pack, whereas "all closed" will signal that an uncoded and wrong tablet pack has been inserted)

The sensing arrangement illustrated in FIG. 6 is only an example of a conceivable circuit for sensing or detecting the removal of a tablet from the pack, and it will be understood that many other circuit embodiments are conceivable. This also applies to the coding possibilities, which can be effected in other ways, e.g. through bar codes (e.g. type EAN) capable of being read when the package is inserted.

Figure 7:
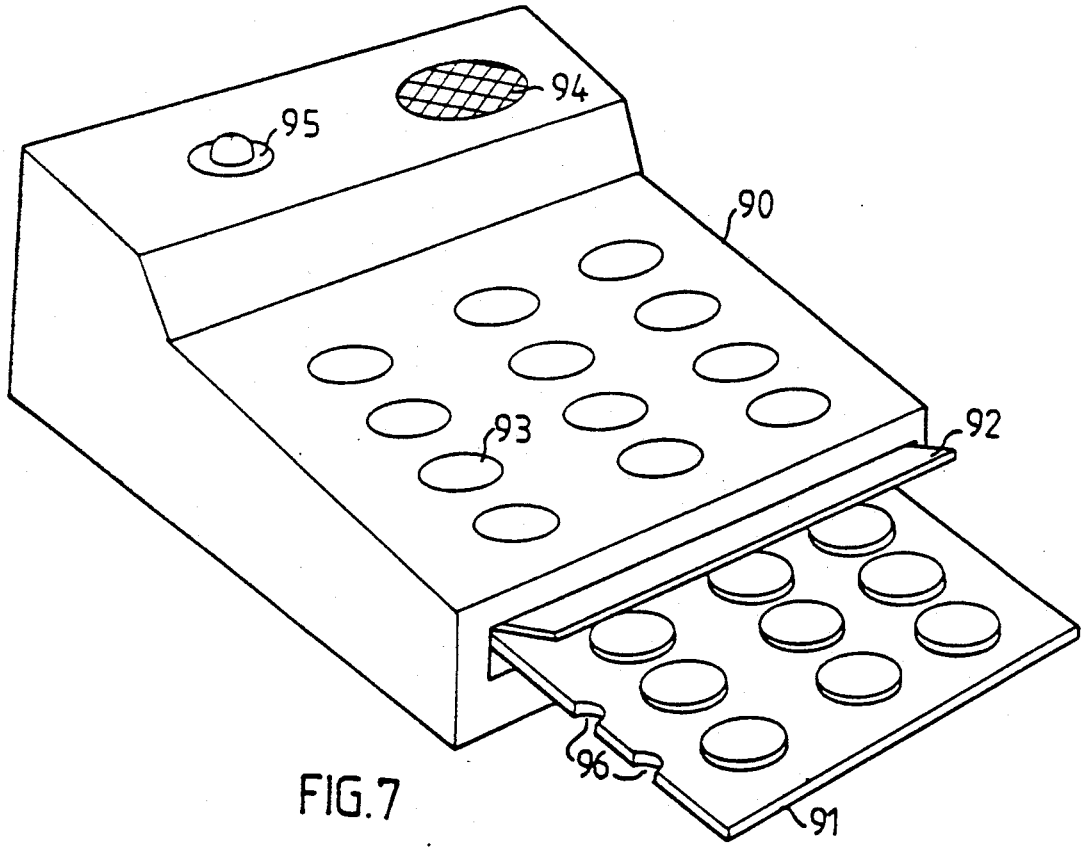
FIG. 7 illustrates an inventive device with a blister pack mounted therein.

FIG. 7 illustrates a device 90 constructed in accordance with the invention, and shows a blister pack 91 being inserted into the device through an open flap 92. The tablet alveoli are available through holes 93, the released tablets falling through holes (not shown) located in the undersurface of the device. The device incorporates a light signal in the form of a signalling lamp 95 and an acoustic signal in the form of a buzzer 94, which will remind a patient that a tablet should be taken, i.e. ingested. Although not shown, the device may be provided with means which enables it to be connected to a data collecting computer, either permanently or temporarily during a visit from the doctor concerned.

FIG. 7 also shows a coding example. The blister pack of this embodiment has formed therein two recesses 96, which as the pack is inserted into the device adjust the mutual positions of two contact arms of microswitches. When, e.g., a further two microswitches are present, their reading value will be the opposite and therewith enable the blister pack to be identified.

We claim:

1. A device for signalling the ingestion of medicaments in tablet form packed in blister packs in which the various tablet compartments on one side are delimited by means of a metal foil sheet which is common to the pack as a whole, the device including a sheet (12) of insulating material having provided therein holes (20) which are so arranged as to correspond to the positions of the tablets in the pack; electrodes (10, 11) having an electrically conductive surface, said electrodes being disposed circumferentially around each hole on one side of the sheet; a first number (10) of these electrodes being mutually connected to a first signal conductor, a second number of said electrodes being mutually connected to a second signal conductor; the foil (2) being arranged such that when a tablet is removed through a hole in the blister pack located in the device, an electric contact is made between an electrode of the said first number of electrodes (10) and an electrode of the second number of electrodes (11) and therewith an electric connection is established between the first and the second signal conductors, the first conductors from all of said first number of electrodes (10) of the holes (20) being mutually connected to a common first signal conductor (100), and the second signal conductors (110, 111, 112) from the various holes (20) being each connected to a respective input of a sensing circuit (FIG. 6).

2. A device according to claim 1, wherein the insulating sheet is a circuit card which has conductors drawn on both sides thereof and in which the first number of electrodes (10) are connected to the common first signal conductor, at least essentially through conductors drawn on one side of the circuit card, whereas the second number of electrodes (11) are connected to the inputs of the sensing circuit at least partly through conductors drawn on the other side of the circuit card.

3. A device according to claim 1, wherein the sensing circuit includes for each second signal conductor a resistor (50), one end of which is connected to voltage source (+V), and an input of a sensing circuit (60–63); and a multiplex device for sensing the states of the various amplifiers, and wherein, with each detected change of state in respective circuits, corresponding to a short circuit between a first (10) and a second (11) signal conductor, a signal (71) is sent to a detecting computer (75).

4. A device according to claim 1, further comprising a code reading arrangement (80–83) for reading a code provided on the blister pack.

5. A device according to claim 4, wherein the code reader comprises a plurality of contact devices which are adapted to be influenced by the presence and absence of recesses (96) in an edge margin of the blister pack.

* * * * *